US005482335A

United States Patent [19]

Zuckerman

[11] Patent Number: 5,482,335

[45] Date of Patent: Jan. 9, 1996

[54] TUBULAR LOCK ASSEMBLY

[75] Inventor: Martin Zuckerman, Villa Park, Calif.

[73] Assignee: Emhart Inc., Newark, Del.

[21] Appl. No.: 283,463

[22] Filed: Aug. 3, 1994

[51] Int. Cl.[6] ..... F05B 13/00

[52] U.S. Cl. ..... 292/359; 292/169.14; 292/358

[58] Field of Search ..... 292/359, 169.14, 292/169.15, 169.16, 169.23, 336.5, DIG. 30, 173, 175, 169.22, 358

[56] References Cited

U.S. PATENT DOCUMENTS

| | | | |
|---|---|---|---|
| 2,814,194 | 11/1957 | North et al. | 292/169.22 X |
| 3,136,572 | 6/1964 | Lytle | 292/169.22 X |
| 4,470,279 | 9/1984 | Neary et al. | 70/134 |
| 5,125,696 | 6/1992 | Robida et al. | 292/169.16 |
| 5,177,987 | 1/1993 | Shen | 70/224 |
| 5,335,948 | 8/1994 | Norton, II et al. | 292/169.23 |
| 5,335,950 | 8/1994 | Mirshafiee et al. | 292/356 |

*Primary Examiner*—Peter M. Cuomo
*Assistant Examiner*—Monica E. Millner
*Attorney, Agent, or Firm*—Spencer T. Smith

[57] ABSTRACT

A tubular lock assembly comprising a latch assembly, an interior operator assembly including a half round portion for operating the latch assembly when rotated from a neutral orientation, a cylindrical coupler including a body portion, an axial bore extending through the body portion, a slot extending through the body portion for receiving the half round portion so that the half round portion and the cylindrical coupler will rotate conjointly, and coupling tang means extending axially from the body portion, a cam assembly including a cylindrical cam support, spindle means supported within the body portion axial bore for supporting the cylindrical cam support for selected rotation, a cam on the cylindrical cam support, a hub assembly comprising a cylindrical housing having a cylindrical inner surface for sliding engagement with the cylindrical cam support so that the cylinder housing can be displaced between axially spaced remote and coupling position relative to the cylindrical cam support, a cam follower secured to the inner surface, a coupling means cooperating with the tang means when the hub assembly is displaced from the remote position to the coupling position to rotatively interconnect the hub assembly and the cylindrical coupler.

10 Claims, 8 Drawing Sheets

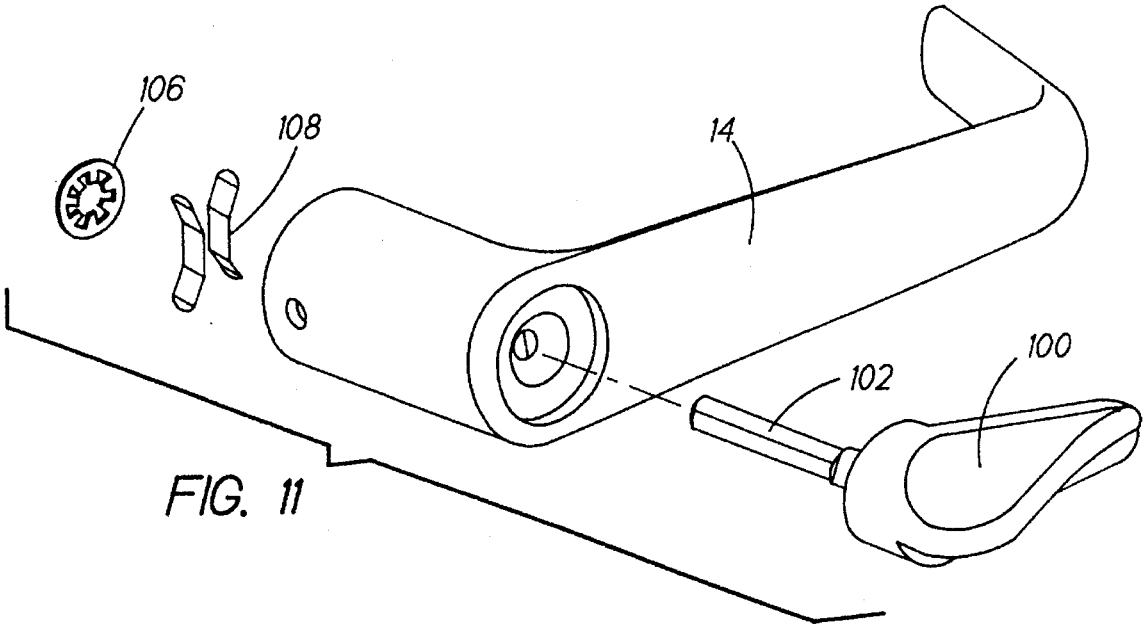
FIG. 11
FIG. 12
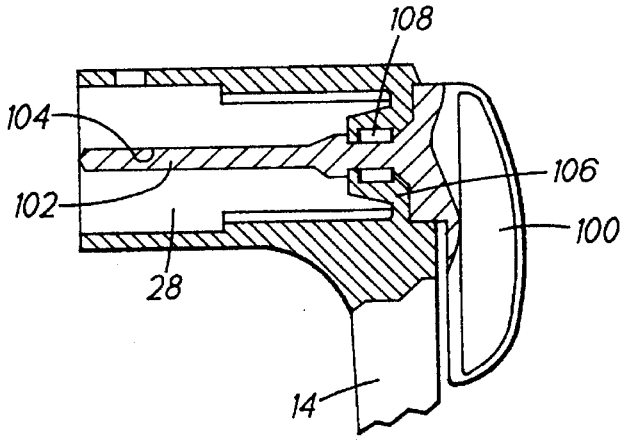

FIG. 14
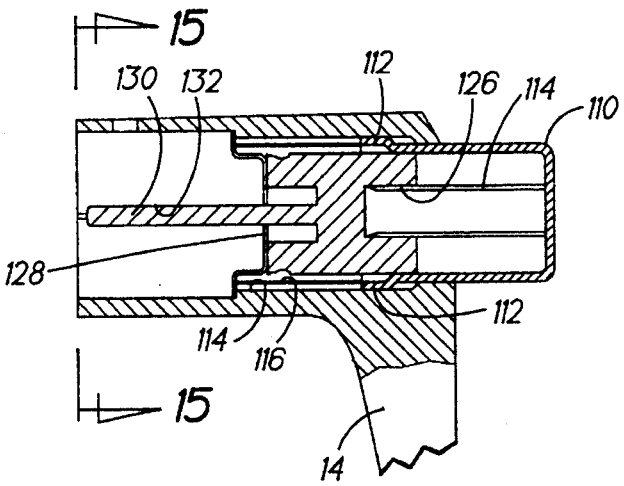
FIG. 15
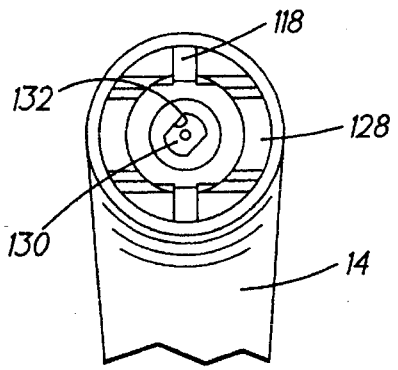
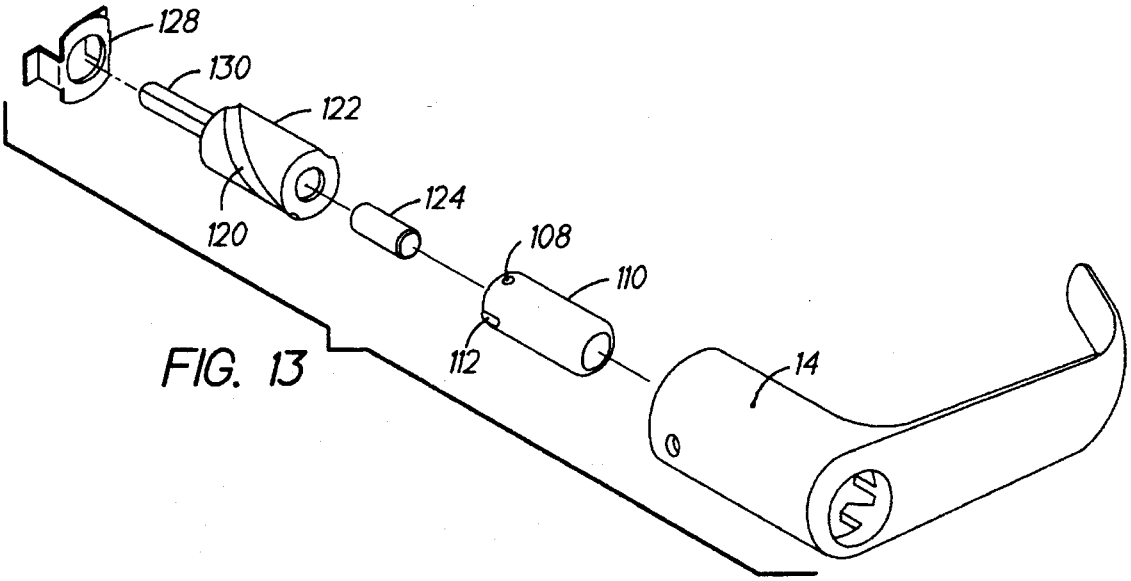
FIG. 13

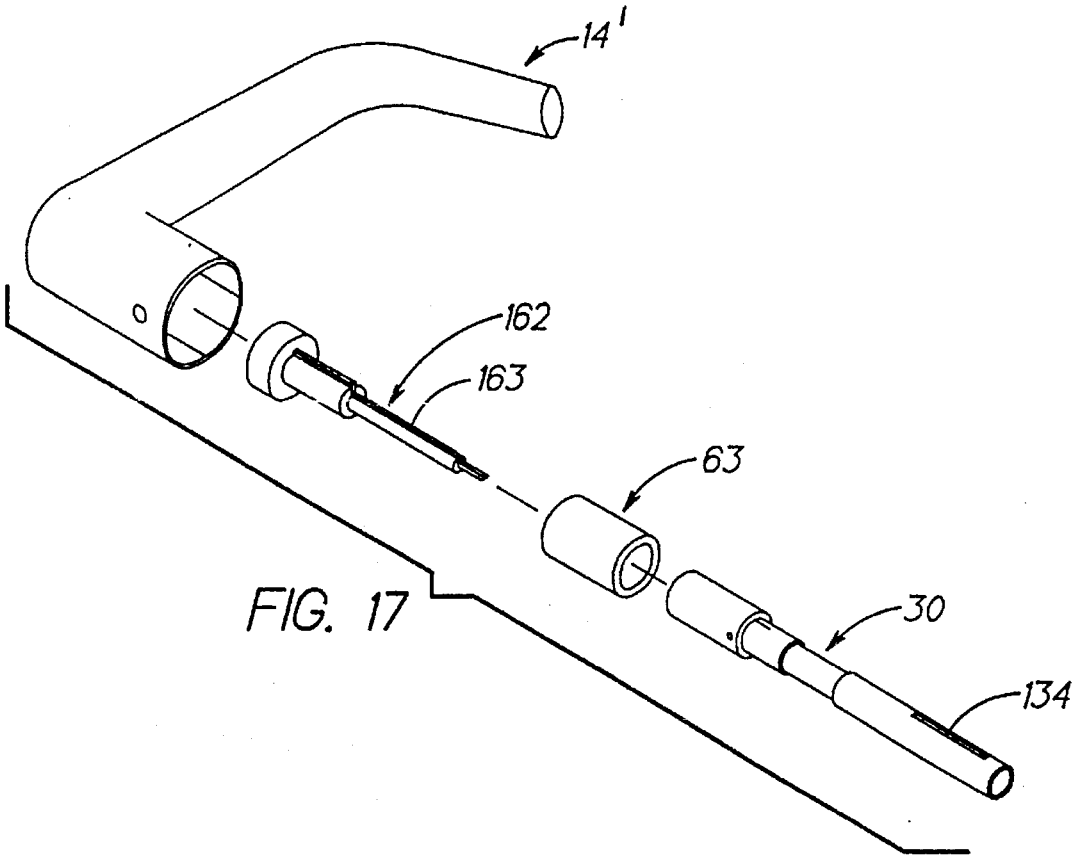
FIG. 17
FIG. 18
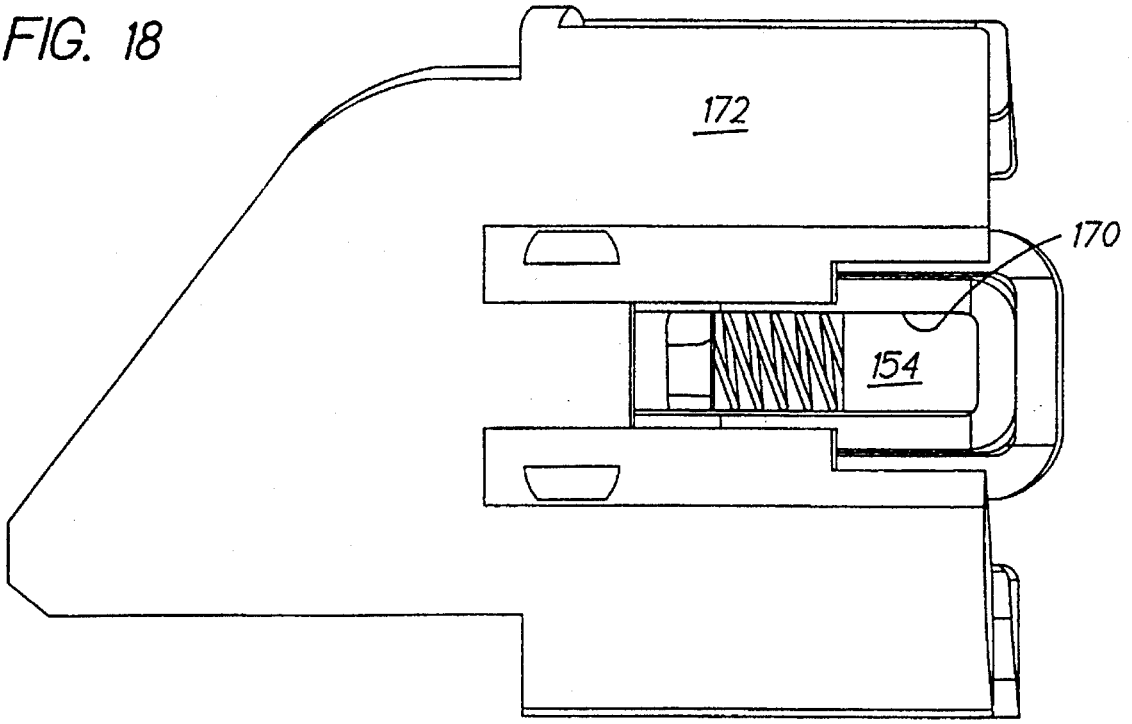

TUBULAR LOCK ASSEMBLY

The present invention relates to tubular lock assemblies which utilize half round sleeves to operate the latch mechanism.

U.S. Pat. Nos. 5,125,696 and 5,269,162 disclose a type of tubular lock assembly in which a half round sleeve is secured to the interior and exterior operators. When the interior operator or an unlocked exterior operator is operated (rotated), the associated sleeve rotates to open the latch. When the exterior operator is locked, rotation is prevented so that the half round associated with that operator cannot rotate to open the latch. If sufficient torque is applied to the exterior operator to destroy the device which prevents rotation, the operator, and hence its half round, will rotate to retract the latch bolt.

It is accordingly an object of the present invention to prevent the retraction of the latch bolt when the device which prevents rotation of the exterior operator is overcome or destroyed.

It is also an object of the present invention to provide such a tubular lock which can be locked from the inside, by turning a turn button or lever or by pushing a button.

It is a further object of the present invention to provide such a push button interior operator whereon operating the operator in either direction releases a depressed push button.

Other objects and advantages of the present invention will become apparent from the following portion of this specification and from the accompanying drawings which illustrate in accordance with the mandate of the patent statutes a presently preferred embodiment incorporating the principles of the invention.

Referring to the drawings:

FIG. 11 is an oblique, separated view of the interior operator having a turn button; and FIG. 12 is a view taken at 12—12 of FIG. 11.

FIG. 13 is an oblique, separated view of the interior operator assembly having a push button;

FIG. 14 is a cross-sectional elevational view of the interior operator assembly;

FIG. 15 is a view taken at 15—15 of FIG. 14;

FIG. 17 is an oblique separated view of an exterior emergency entrance operator;

FIG. 18 is a top view of the bolt portion of the latch mechanism.

Figure 1:
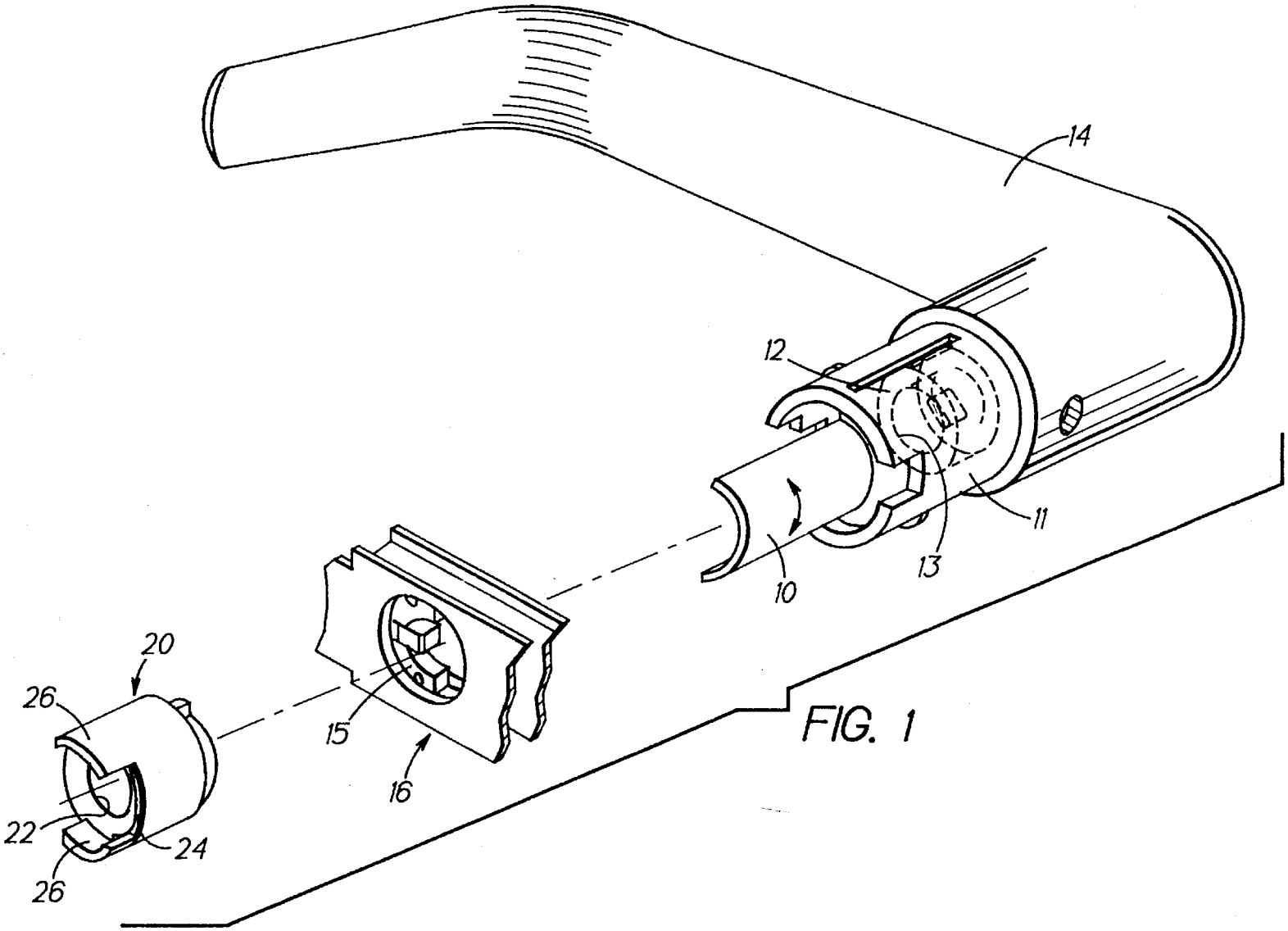
FIG. 1 is an oblique view of a half round of an interior operator assembly of a tubular lock assembly.
Figure 3:
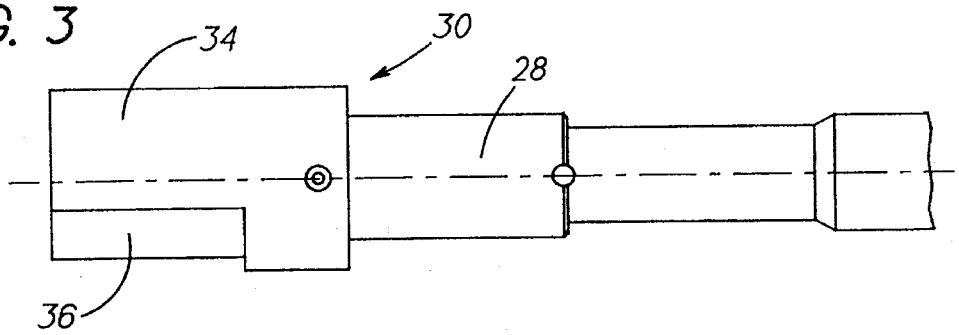
FIG. 3 is a view taken at 3—3 of FIG. 2.
Figure 4:
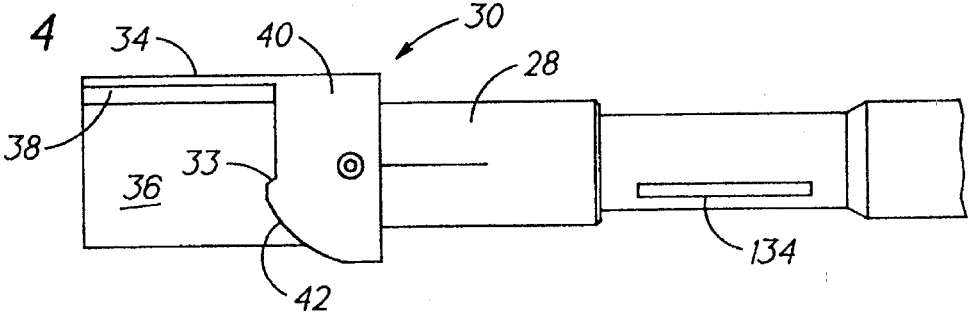
FIG. 4 is a view taken at 4—4 of FIG. 2.
Figure 5:
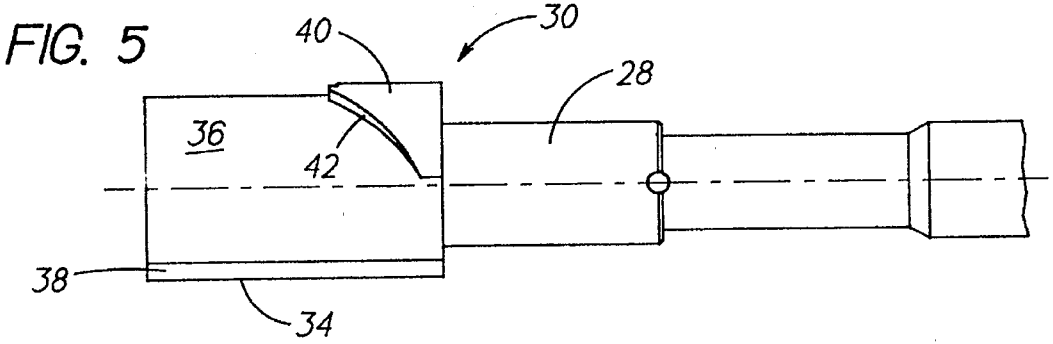
FIG. 5 is a view taken at 5—5 of FIG. 2.
Figure 2:
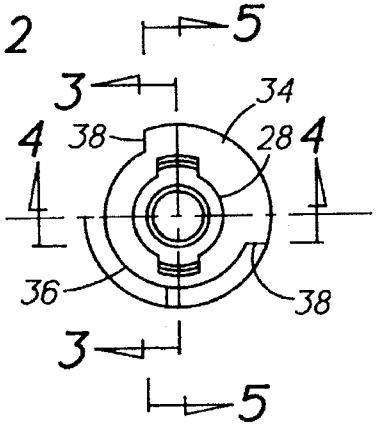
FIG. 2 is an end view of a tubular cam positioned on a supporting rod.
Figure 6:
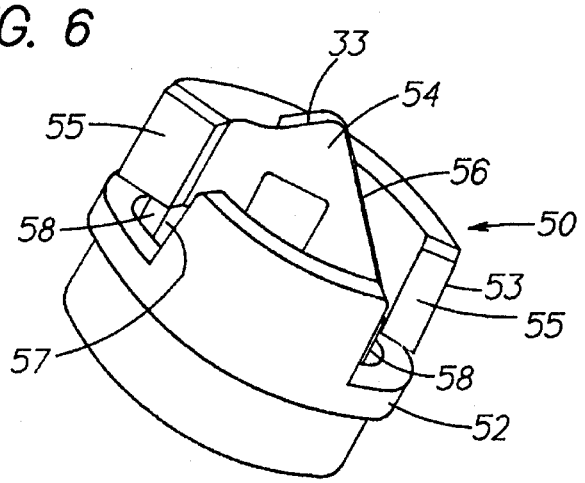
FIG. 6 is an oblique view looking into a cam follower which is received by the cam.

The interior operator (handle) assembly has a sleeve having a half round portion 10 at one end and a cylindrical portion 11 at the other end supporting a plastic bushing 12 having an axial thru-bore 13. This cylindrical end 11 is secured to the interior operator 14. When this operator is rotated in either direction from a neutral orientation this half round portion 10 will engage a retractor slide 15 of a conventional latch assembly 16 to retract the latch bolt 172 (FIG. 18).

Received on the half round portion 10 is a cylindrical coupling 20 which has an axial thru-bore 22, an axially extending half round receiving slot 24 which extends completely through the coupling, and a pair of axially forwardly (towards the exterior operator) projecting coupling tangs 26. Extending through the axial thru-bore of the coupling 20, the latch assembly 16 and extending into the bushing bore 13 is the spindle 28 (FIGS. 2–5) of a cam assembly 30. A cylindrical cam support 32 having an enlarged portion 34 and a circumferentially continuous reduced diameter portion 36, which together define circumferentially spaced opposed axially extending steps or stops 38, is secured to the forward end of the spindle and a cam 40 having a helical camming surface 42 is secured to the reduced diameter portion 36. The half round portion 10 of the interior operator assembly is inserted into the half round receiving slot 24 in the coupling so that the interior operator and the coupling will rotate together.

Figure 7:
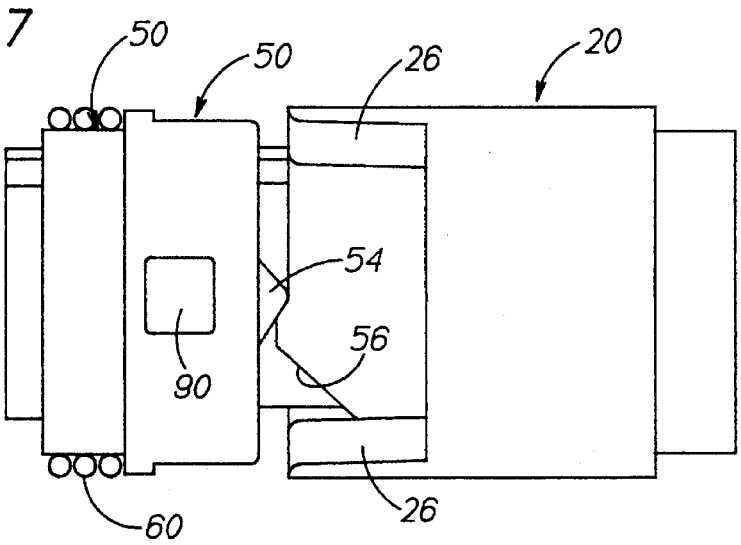
FIG. 7 is a side view showing the cam follower at one extreme position on the cam.
Figure 8:
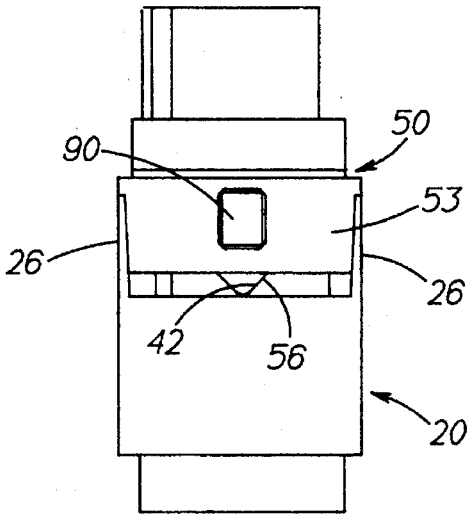
FIG. 8 is a view similar to FIG. 7 showing the follower at a second extreme position on the cam.
Figure 9:
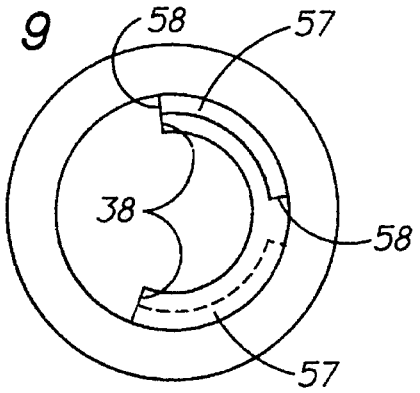
FIG. 9 is a view taken at 9—9 of FIG. 8.

A cylindrical hub 50 (FIGS. 6–9) has a cylindrical portion 52 and a semi cylindrical portion 53 which are slidably displaced onto the enlarged diameter portion 34 of the cam support 32. The hub 50 also has a cam follower 54 having cam following helical surfaces 56 and a base 57 at its forward end which defines axially extending opposed side stop surfaces 58. One of these stop surfaces 58 abuts against one of the cam support steps 38 to define the orientation relationship shown in FIG. 7 and the other stop surface 58 abuts against the second cam support step 38 to define the orientation relationship shown in FIG. 8. FIG. 7 illustrates a decoupled relationship and FIG. 8 shows the coupling of the hub 50 and the coupling 20 (the tangs 26 of the coupler 20 now engage the stop surfaces 55 of the semi cylindrical portion 53 of the hub) so that rotation of the exterior operator will result in rotation of the half round portion to open the latch. A spring 60 biases the hub cam follower 54 against the cam element 40. As can be seen from FIG. 7, the end of the cam element 54 ends with a detent 33 so that after the cam follower helical surface 56 is displaced past the cam surface 42, the pointed end of the cam follower will be pushed into engagement with the detent. This will prevent a change in orientation as a result of vibration or the like.

Figure 10:
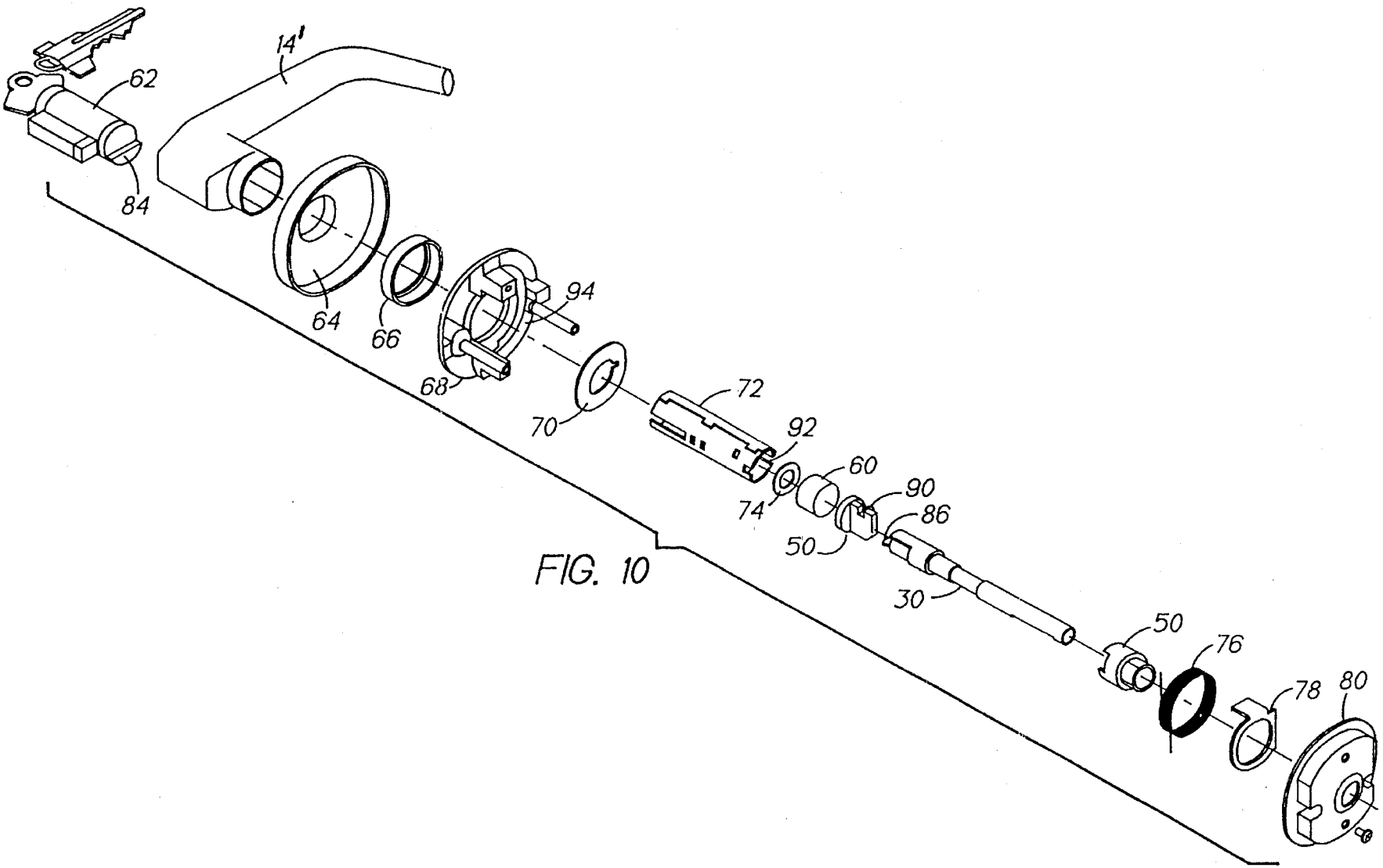
FIG. 10 is an oblique, separated view of a portion of the tubular lock assembly including the exterior operator.

The exterior operator assembly which is shown in FIG. 10 includes an operator (lever or handle) 14' which supports a key operated lock 62, a rose cover 64, a bearing support 66, a rose liner 68, a support washer 70, a sleeve 72, a spring stop plate 74, the spring 60, the hub assembly 50, the cam assembly 30, the coupling 20, a torque spring 76, a torque spring housing 78 and a collar 80.

The plug 63 of the lock 62 has a cross slot 84 for receiving a forwardly projecting tang 86 on the cam support 32 so that rotation of the key 90° from an open position to a lock position will conjointly rotate the cam assembly about its spindle. Such rotation forcefully axially displaces the hub assembly from its coupling position (FIG. 8) to its decoupling position (FIG. 7) where it will be maintained by the detent 33. This detent will be released when the turn button is turned to the open position. The hub pin 90 (FIGS. 6 and 7) is located within a slot 92 in the sleeve 72 which restricts the hub to axial movement. At the decoupling position, this pin 90 is located within an axially extending keyway 94 in the rose liner 68. Since the rose liner is secured to the door, the operator cannot rotate when the door is locked. When the key is rotated 90° to open the door the hub and coupling will interconnect so that turning the exterior operator will retract the latch bolt. In the event a rotative force is applied to the lever sufficient to break the pin off the hub, the rotation of the lever cannot open the latch since the hub is not coupled with the coupling.

The door can also be locked from the inside if the interior operator has a turn button 100 (FIGS. 11 and 12). The turn button has a non round shaft 102 which is received within a matching non round hole 104 in the cam assembly spindle 28. It is retained by a push-on ring 106 and will be held at 90° positions by a spring detent 108.

The door can also be locked from the inside by depressing a push button 110 (FIGS. 13–15). The push button 110 has a pair of opposed keys 112 on the outer cylindrical surface which are received by suitable keyways 114 in the lever bore 116 so that the push button can be advanced without rotation. The push button has an inwardly projecting stake 118 (FIG. 11) which is located within a helical groove 120 in the privacy drive cam 122 around which the push button is located. A compression spring 124 is located within a bore 126 in the privacy drive cam and is compressively positioned between the privacy drive cam 122 and the push button 110. Forward movement of the push button is limited by a stop 128. The privacy drive cam 112 has a forwardly projecting non-round shaft 130 which is received by a matching non-round bore 132 in the cam support spindle 28.

Figure 16:
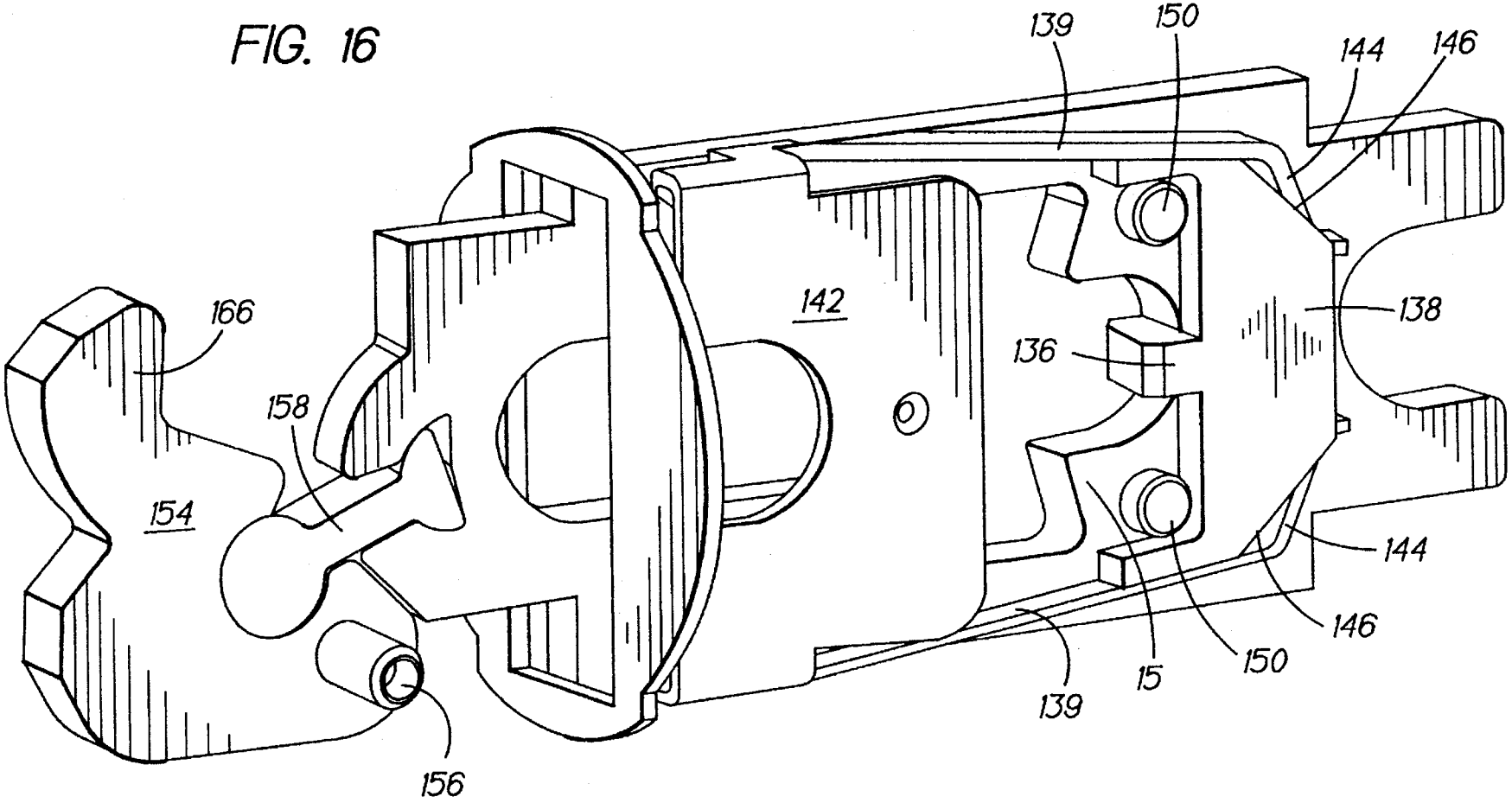
FIG. 16 is an oblique view of the latch mechanism.

The latch assembly is shown in FIGS. 16 and 17. When the privacy button is pushed, the cam support spindle 28 is rotated to present a spindle slot 134 (FIG. 4) to the catch 136 of a slide element 138. The slide element 138 is biased towards the spindle by a pair of springs 139 which are supported by a spring casing 142. These springs have bent ends 144 which engage beveled surfaces 146 on the slide element 138. When the slot 134 faces the catch 136, the springs force the catch into the slot to keep the spindle at the orientation that defines a decoupled condition which locks the exterior operator. The slot 134 and catch 136 accordingly define a detent. This detent can be released in three ways: The interior operator can be rotated to displace the retractor slide 15 which has a pair of posts 150 which will engage and conjointly displace the slide element 138 out of the slot; a person outside the door can insert a suitable unlocking pin into the hole (not shown) in the exterior operator 14' (FIG. 18) to rearwardly displace the emergency actuator 162 within a bore in the spindle which includes the slot (the emergency actuator 162 has an enlarged portion 163 which fills the slot when so displaced to release the catch); and the latch cam 154 which is pivotally supported by a rivet 156 secured to the latch housing will be pivoted, whenever the door is closed, to displace the retractor slide 15 (and hence, the slide element 138) via a link 158 (the upper end 166 of latch cam 154 is received within a suitable opening 170 in the latch bolt 172 which is sized so that it will be effectively filled by the upper end of the cam 166).

I claim:

1. A tubular lock assembly comprising a latch assembly, an interior operator assembly including a half round portion for operating said latch assembly when rotated from a neutral orientation, a cylindrical coupling including a body portion, an axial bore extending through said body portion, an axial slot extending through said body portion for receiving said half round portion so that said half round portion and said cylindrical coupling will rotate conjointly, and coupling tang means extending axially from said body portion, a cam assembly including a cylindrical cam support, spindle means supported within said body portion axial bore for supporting said cylindrical cam support for selected rotation, a cam on said cylindrical cam support, an exterior operator assembly including a hub having a cylindrical portion having a cylindrical inner surface for sliding engagement with said cylindrical cam support, a cam follower on said inner surface for engaging said cam so that said hub can be displaced relative to said cylindrical cam support between axially spaced decoupling and coupling positions as said spindle means is rotated from a first decoupling orientation to a second coupling orientation, coupling means cooperating with said tang means when said hub is displaced from said decoupling position to said coupling position to rotatively interconnect said hub assembly and said cylindrical coupling, and means for preventing the rotation of said hub when said hub is at said decoupling position.

2. A tubular lock assembly according to claim 1, wherein said interior operator assembly further comprises a turn lever rotatable from a neutral position to a locking position, and means for interconnecting said turn lever to said spindle means.

3. A tubular lock assembly according to claim 1, wherein said exterior operator assembly further comprises key plug means rotatable 90° from a neutral orientation to a locking orientation to lock said exterior operator, said key plug means including a cross slot and wherein said cylindrical cam support includes a tailpiece that can be inserted into said cross slot to rotatively interconnect said key plug means and said cam assembly so that said cam assembly will be rotated between said decoupling and coupling positions as said key plug means is rotated between said neutral and locking orientations.

4. A tubular lock assembly according to claim 1, wherein said interior operator assembly further comprises a push button, and cam means operatively connected to said spindle means and said push button for rotating said spindle means from said coupling to said decoupling orientation as said button is pushed.

5. A tubular lock assembly according to claim 2, further comprising detent means for maintaining said hub at said decoupling position.

6. A tubular lock assembly according to claim 5, wherein said turn lever, when rotated to said neutral position, releases said detent means.

7. A tubular lock assembly according to claim 3, further comprising detent means for maintaining said hub at said decoupling position.

8. A tubular lock assembly according to claim 7, wherein said key plug means, when rotated to said neutral orientation, releases said detent means.

9. A tubular lock assembly according to claim 4, further comprising detent means for maintaining said hub at said decoupling position.

10. A tubular lock assembly according to claim 9, wherein said latch assembly comprises means for releasing said detent means when said half round portion is rotated in either direction from said neutral orientation.

* * * * *